US007810369B2

(12) United States Patent
Rouweler et al.

(10) Patent No.: US 7,810,369 B2
(45) Date of Patent: Oct. 12, 2010

(54) FORMING TOOL WITH IMMOBILIZING MEANS FOR THE ACTUATING MEMBER OF THE SAFETY MEMBER

(75) Inventors: Franciscus Wilhelmus Rouweler, Arnhem (NL); Gerrit Bruggink, Hengelo (NL)

(73) Assignee: Wila B.V., Goorseweg (NL)

( * ) Notice: Subject to any disclaimer, the term of this patent is extended or adjusted under 35 U.S.C. 154(b) by 0 days.

(21) Appl. No.: 12/093,044

(22) PCT Filed: Nov. 11, 2005

(86) PCT No.: PCT/EP2005/012200

§ 371 (c)(1),
(2), (4) Date: Oct. 8, 2008

(87) PCT Pub. No.: WO2007/054121

PCT Pub. Date: May 18, 2007

(65) Prior Publication Data

US 2009/0217731 A1 Sep. 3, 2009

(51) Int. Cl.
*B21D 37/00* (2006.01)

(52) U.S. Cl. ..... 72/482.1; 72/482.91

(58) Field of Classification Search ..... 72/481.1, 72/482.1, 482.2, 482.91, 389.3, 482.6
See application file for complete search history.

(56) References Cited

U.S. PATENT DOCUMENTS

| | | | | |
|---|---|---|---|---|
| 4,509,235 | A | 4/1985 | Sakamoto | |
| 4,581,811 | A | 4/1986 | Eckle | |
| 4,719,690 | A | 1/1988 | Eckle | |
| 4,726,111 | A | 2/1988 | Schweizer | |
| 4,930,332 | A | 6/1990 | Hongo | |
| 5,009,098 | A | 4/1991 | van Merksteijn | |
| 5,022,256 | A | 6/1991 | van der Meulen | |
| 5,103,665 | A | 4/1992 | van Merksteijn | |
| 5,245,854 | A * | 9/1993 | Bruggink et al. | 72/481.7 |
| 5,908,374 | A | 6/1999 | Kato | |
| 6,003,360 | A | 12/1999 | Runk et al. | |
| 6,327,884 | B1 | 12/2001 | Wills | |
| 6,467,327 | B1 | 10/2002 | Runk et al. | |
| 6,516,649 | B1 | 2/2003 | Mika et al. | |

(Continued)

FOREIGN PATENT DOCUMENTS

DE 39 33 736 A1 6/1990

(Continued)

OTHER PUBLICATIONS

Wilson Tool, Mar. 2006 Brochure.

(Continued)

*Primary Examiner*—Dana Ross
*Assistant Examiner*—Mohammad Yusuf
(74) *Attorney, Agent, or Firm*—The Webb Law Firm

(57) ABSTRACT

The invention relates to a device for forming, such as a press tool comprising: a body having a receiving structure end for receiving into a receiving structure of a folding press, which end is connected via a central portion to a tool end, at least one safety member which can protrude beyond a surface plane of the receiving structure end, and an actuating member which is movable in a first direction and which is coupled to a safety member, comprising immobilizing means for making the actuating member inoperative.

16 Claims, 7 Drawing Sheets

U.S. PATENT DOCUMENTS

| | | | | |
|---|---|---|---|---|
| 6,557,390 | B2 | 5/2003 | Runk et al. | |
| 6,564,611 | B2 | 5/2003 | Harrington et al. | |
| 6,732,564 | B2 | 5/2004 | Runk et al. | |
| 6,843,760 | B2 | 1/2005 | Akami et al. | |
| 6,848,291 | B1 | 2/2005 | Johnson et al. | |
| 6,928,852 | B2 | 8/2005 | Enderink | |
| 7,004,008 | B2 | 2/2006 | Harrington et al. | |
| 7,021,116 | B2 | 4/2006 | Harrington et al. | |
| 2004/0187552 | A1 | 9/2004 | Enderink | |
| 2005/0000267 | A1 * | 1/2005 | Harrington et al. | 72/481.1 |

FOREIGN PATENT DOCUMENTS

| | | | |
|---|---|---|---|
| DE | 20 2005 010693 | U1 | 9/2005 |
| EP | 0 427 661 | B1 | 5/1991 |
| EP | 0 494 714 | A1 | 7/1992 |
| EP | 0 974 422 | A1 | 1/2000 |
| EP | 1 600 257 | A | 11/2005 |
| EP | 1 698 408 | A | 9/2006 |
| EP | 1 864 752 | A1 | 12/2007 |
| GB | 2177631 | A | 1/1987 |
| JP | 2006234018 | A | 9/2006 |
| NL | 9100034 | | 8/1992 |
| WO | WO 02/102544 | A | 12/2002 |
| WO | WO 2004/024361 | A | 3/2004 |

OTHER PUBLICATIONS

M. Karkkainen, Timo Ala-Risku and Petri Kiianlinna; "Item Identification. Applications and Technologies"; Tai Research Center, Helsinki, FI, 2001; pp. 1-60 (XP-002333320).

* cited by examiner

FORMING TOOL WITH IMMOBILIZING MEANS FOR THE ACTUATING MEMBER OF THE SAFETY MEMBER

BACKGROUND OF THE INVENTION

1. Field of the Invention

The invention relates to a device for forming, such as a press tool comprising:

a body having a receiving structure end for receiving into a receiving structure of a folding press, which end is connected via a central portion to a tool end, at least one safety member which can protrude beyond a surface plane of the receiving structure end, and an actuating member which is movable in a first direction and which is coupled to a safety member.

2. Description of Related Art

Such a device is known from EP-A-0 494 714. This document describes a press tool in which the safety member is operated by an actuating member, enabling direct insertion into and removal from a receiving structure of a folding press, substantially perpendicular to the length of the receiving structure.

The safety member extends in the embodiment of this document out of a side surface of the receiving structure. U.S. Pat. No. 6,467,327 discloses an embodiment with a safety member extending from a top surface of the receiving structure.

Sometimes the actuating member is operated by accident as a result of which the press tool may at least partially fall out of the receiving structure. It is an object of the invention to prevent accidental actuation of the safety member.

EP-A-1 493 506 describes a press tool having a lockable safety member. This document provides a solution for the problem that a spring biased safety member can be disengaged from the tool holder while manipulating the tool within the receiving structure. By sliding the tool in the receiving structure it is possible that the safety member is pressed inwardly, which could cause the tool to fall out of the receiving structure.

This document, EP-A-1 493 506 provides a lock for the safety member, such that the safety member, in locked situation, is like a fixed safety member. In order to remove a tool with locked safety member, the safety member first has to be unlocked, after which the safety member can be disengaged. This is similar to a locked door, in which the lock of the door first has to be unlocked by using a key and afterwards the door can be opened by operating the door handle. So the lockable safety member of EP-A-1 493 506 needs additional operations in order to remove the tool from the receiving structure.

Another disadvantage of this embodiment is that when the safety member is locked, the tool cannot be inserted into the receiving structure substantially perpendicular to the length of the receiving structure. It could even damage the receiving structure of the safety member when insertion of a tool with locked safety member is nevertheless tried.

Still another disadvantage of EP-A-1 493 506 is that in unlocked state, the tool can be removed in a non controlled manner. The spring biased safety member determines the force necessary to pull out the tool from the receiving structure. If the spring is weak, the tool can even fall out spontaneously.

SUMMARY OF THE INVENTION

It is expressly not the object of the invention to provide a lockable safety member, but to prevent accidental operation of the actuating member.

This object is achieved by the invention which is characterized by immobilizing means for making the actuating member inoperative. By making the actuating member inoperative it is no longer possible to operate the safety member.

Immobilizing of the actuating member does not necessarily result in an immobilized safety member not able to perform the intended function. So with immobilized actuating member, a tool can still be inserted in an insertion direction substantially perpendicular to the length of the receiving structure into a receiving structure, while the safety member prevents the tool from falling out of the receiving structure. The tool can however not be taken out in the opposite insertion direction substantially perpendicular to the length of the receiving structure as long as the actuating member is immobilized.

In a preferred embodiment of the device according to the invention the immobilizing means comprise a cam for blocking movement of the actuating member in the first direction, and wherein at least a part of the actuating member is movable in a second direction different from the first direction, such that the actuating member can be moved beyond the blocking cam. Preferably, the second direction is substantially perpendicular to the first direction and in particular the second direction is substantially perpendicular to the length of the receiving structure.

The cam prevents the operation of the actuating member by accident. The operator needs to first shift the actuating member in the second direction after which the actuating member can be pressed in the first direction such that the safety member is operated.

Preferably the device comprises spring means, such as a leaf spring or coil spring, for urging the actuating member in the second direction towards the blocking position. The leaf spring ensures that the actuating member is always urged back to its blocked position, such that also after accidently touching the actuating member several times, the actuating member is still in the blocked position and not slowly moved to a position in which the actuating member still can be accidently operated.

The cam is preferably arranged at the body, but can also be provided at the actuating member.

In another embodiment of the device according to the invention, the actuating member has an operating portion, which is movable in the second direction. In this embodiment the operating portion is blocked and has to be moved in the second direction, after which the operating portion can be pressed in order to actuate the safety member.

Preferably the actuating member is rigidly connected to the safety member. By rigidly connecting the safety member to the actuating member less movable parts are present in the press tool, which decreases the chance on faulty operation.

In another preferred embodiment of the device according to the invention the actuating member comprises a guide member extending in the actuating direction and wherein the immobilizing means comprise blocking means for blocking the movement of the guide member. Instead of blocking the actuating member it is also possible to block the movement of the guide member, which guides the actuating member within the tool body.

In another preferred embodiment the blocking means comprise a slide member arranged at the body, which slide member is slidable to a position blocking the movement of the guide member. This slide member can be spring biased towards the blocking position. An operator has to slide the slide member before the actuating member can be operated.

In still another embodiment of the press tool according to the invention the blocking means comprise a spreading member arranged relative to the guide member such that the spreading member is blocking the movement of the guide member in non-spreaded state, and relative to a spread actuating member for bringing the spreading member in a spreaded state unblocking the guide member. Obviously, the reversed situation is also feasible. In which the spreading member is blocking the movement in a spreaded state, and is deblocking in the non-spreaded state.

Preferably the spreading member is coaxially arranged with the guide member. Furthermore the spreading and the despreading may be controlled by the actuation system.

This spreading member can comprise a ring and fingers arranged to the ring extending towards the axis of the ring, and wherein the spreading actuating member is a pin having a diameter smaller than the inner diameter of the ring. By pressing the pin into the spreading member, the fingers of the spreading member are pushed outwardly providing space for the guide member such that the actuating member can be operated.

In yet another embodiment of the device according to the invention, the safety member is slidably arranged in the body, wherein the actuating member is slidably arranged in the body and further comprising a lever coupled between the actuating member and the safety member and wherein the immobilizing means comprise a lever actuating member for moving the lever from a disengaged position to an engaged position. When the lever is in disengaged position, the actuating member can be operated, but this has no influence on the safety member. As a result the actuating member is immobilized in performing the intended function. Now by operating the lever actuating member, the lever is placed into an engaged position such that by operating the actuating member the safety member is operated.

Preferably the lever actuating member is substantially coaxially arranged to the actuating member. The actuating member could comprise a guide member extending in the actuating direction and the lever actuating member is slidably guided by the guide member. This provides for a cost-effective embodiment of the device according to the invention.

Preferably the lever is a leaf spring. This enables to change the shape of the lever when being operated by the lever actuating member. This provides the possibility for a better engagement of the lever onto the safety member and the actuating member.

BRIEF DESCRIPTION OF THE DRAWINGS

These and other features of the invention will be elucidated in conjunction with the accompanying drawings.

DETAILED DESCRIPTION OF THE PREFERRED EMBODIMENTS

Figures 1A, 1B, 1C, 1D, 1E:
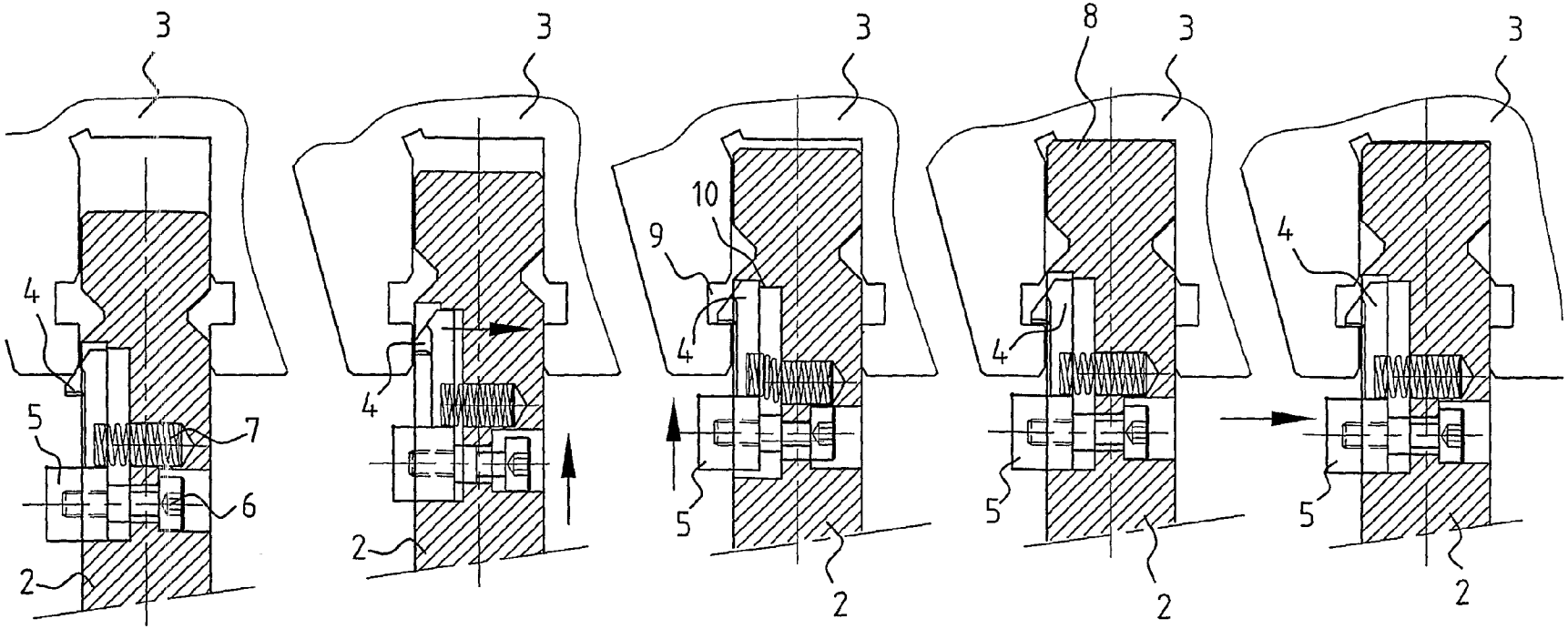
FIGS. 1A-1E show a first embodiment of a press tool according to the invention in cross-sectional view.

FIGS. 1A-1E show a first embodiment 1 according to the invention. A tool 2 is inserted into a receiving structure 3 ok a folding press. The tool 2 has a safety member 4, which is rigidly connected to an actuating member 5. The actuating member 5 is guided by a guide member 6. A spring 7 urges the actuating member 5 to its starting position, as shown in FIG. 1A. The safety member 4 protrudes beyond and out of the surface of the receiving structure end. However, it is also possible that the safety member lies in the top surface but still extends and protrudes beyond the now surface plane without departing from its intended function.

In FIG. 1B the tool 2 is inserted into the receiving structure 3. The safety member 4 is pressed inwardly as a result of the beveled portion.

In FIG. 1C the tool 2 is shifted a bit downward such that the actuating member 5 is shifted into a second direction relative to the tool body 2, that is perpendicular to the length of the receiving structure 3. As a result the actuating member 5 is blocked by a cam 10 and prevents operating of the actuating member 5.

In FIG. 1D the tool 2 is clamped by the receiving structure 3. This is clear from FIG. 1D in that the top portion 8 of the tool 2 is in abutment with the ceiling of the cavity in the receiving structure 3. The safety member 4 extends into a cavity 9 and prevents the tool from falling out of the receiving structure 3 as soon as the clamping force is removed. This is shown in FIG. 1C.

If the tool 2 has to be removed from the receiving structure 3, the clamping force is removed and the tool 2 has to be maintained in the position shown in FIG. 1E. Only in this position the actuating member 5 can be pressed inward, such that the safety member 4 can be retracted into the tool body. If the tool 2 is not maintained in the position shown in FIG. 1E, the tool 2 will slide downward into the position, shown in FIG. 1C. In this position the actuating member 5 is blocked by the cam 10 and operating of the actuating member 5 is prevented.

Figure 2B:
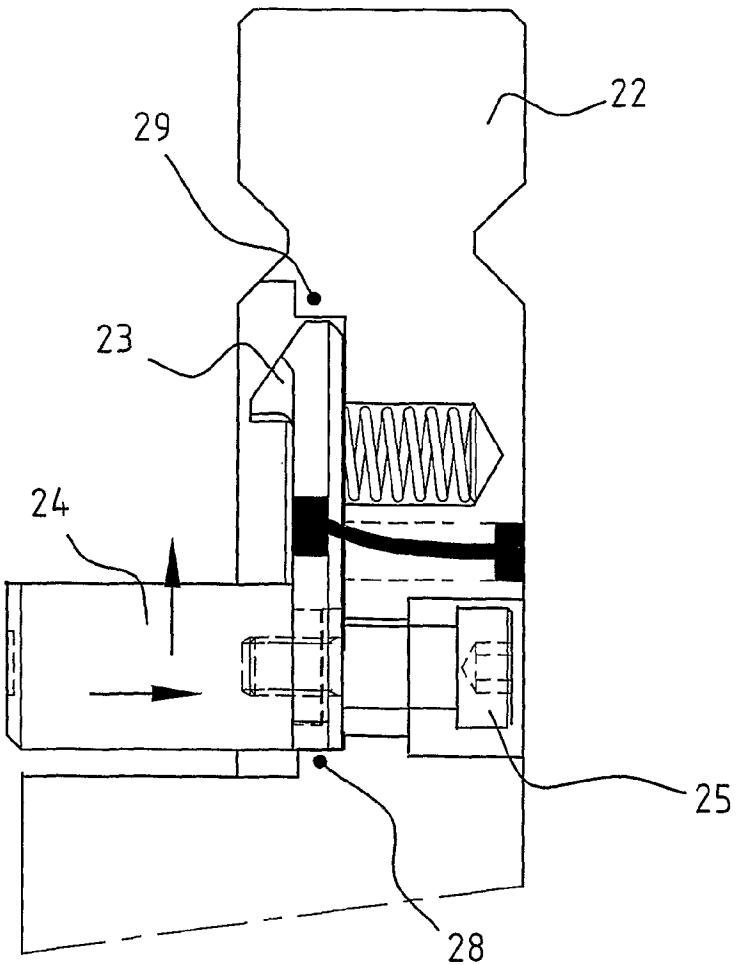
FIGS. 2A and 2B show a second embodiment of a press tool according to the invention.
Figure 2A:
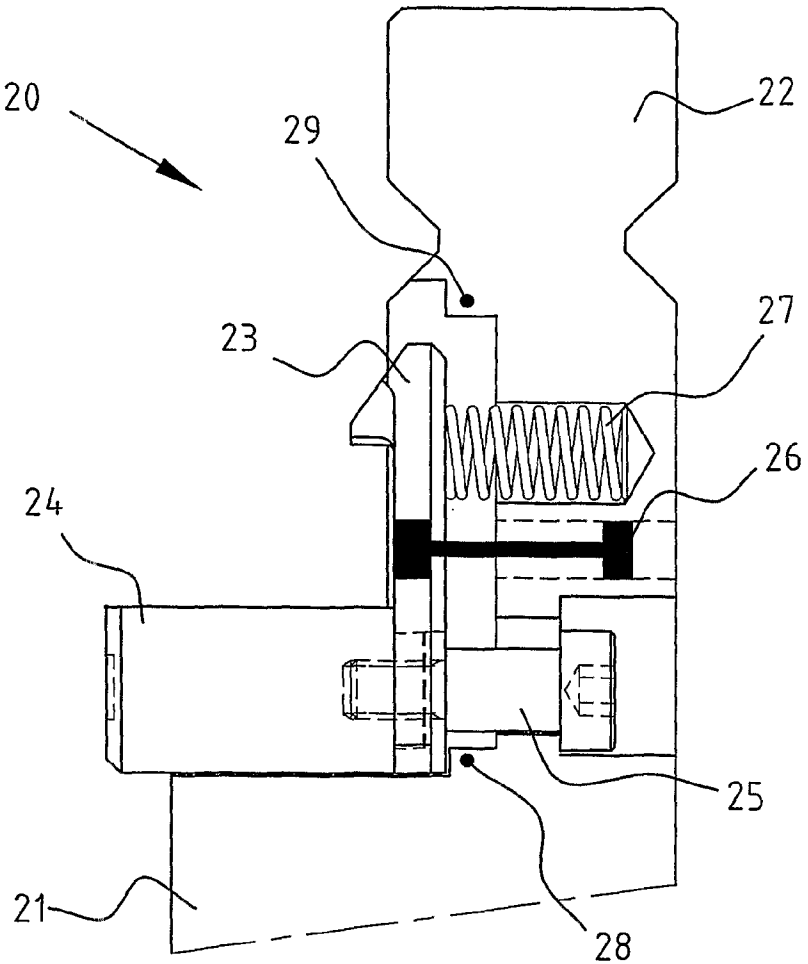

FIGS. 2A and 2B show a second embodiment 20 of a press tool according to the invention. The tool 20 has a body 21 and a receiving structure end 22. In this receiving structure end 22 a safety member 23 is arranged, which is rigidly connected to an actuating member 24. The actuating member 24 is guided by a guide member 25. The actuating member 24 can be displaced in a vertical direction and in a horizontal direction in line with the guide member 25. A leaf spring 26 urges the actuating member 24 downwardly, while the coil spring 27 urges the actuating member and consequently the safety member 23 out of the body 21.

The body 21 has a cam 28 and cam 29, which prevent the actuating member 24 to be operated by accident. An operator first has to move the actuating member 24 up to a center position in between both cams 28, 29, after which the actuating member 24 can be pressed inwardly and as a result the safety member 23 can be operated (see FIG. 2B).

Figures 3A, 3B, 3C:
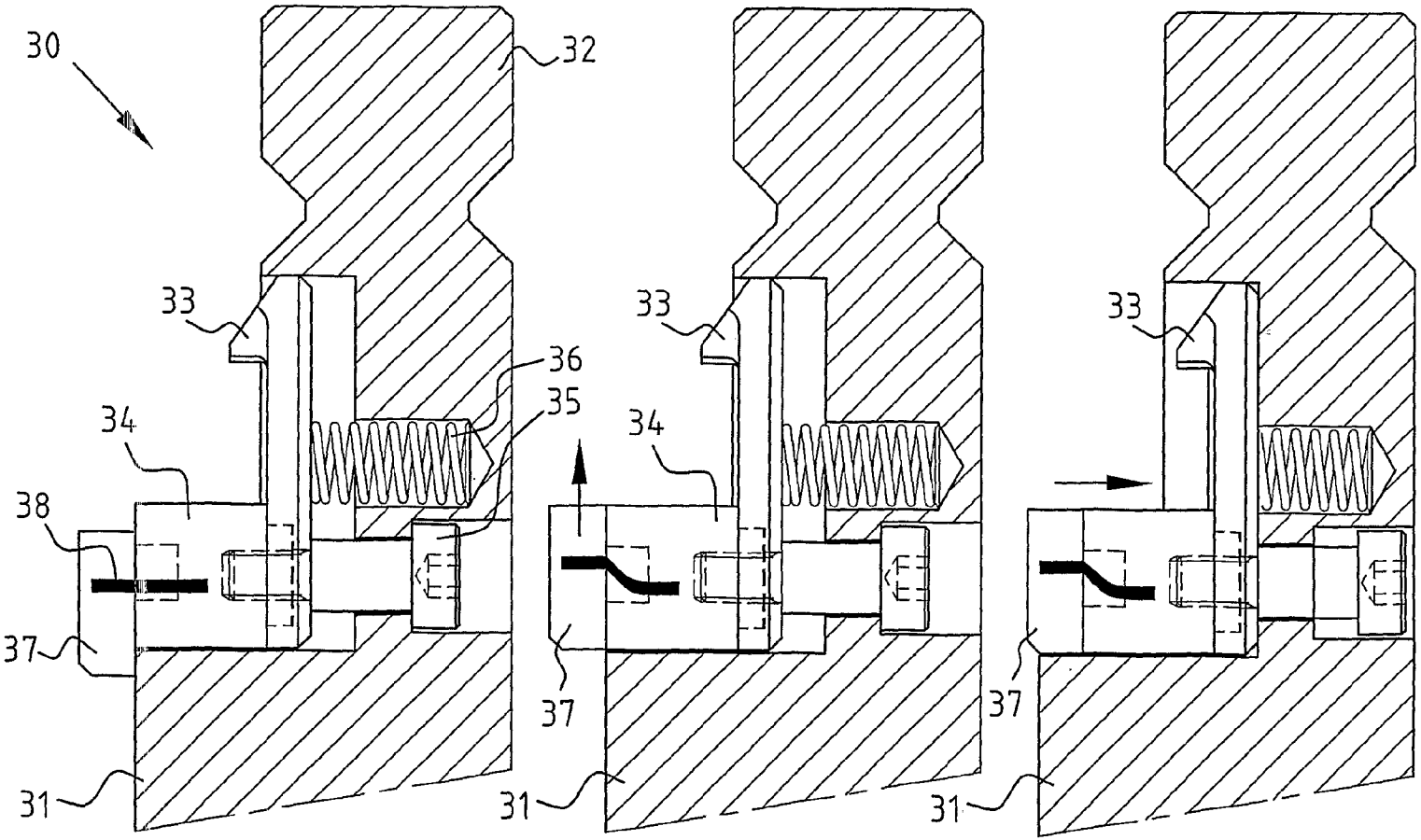
FIGS. 3A-3C show a third embodiment according to the invention in cross-sectional view.

FIGS. 3A-3C show a third embodiment 30 of a tool according to the invention. This tool has a body 31 and a receiving structure end 32. A safety member 33 is arranged in the tool body 31 and can be operated by the actuating member 34. The actuating member 34 is guided by a guide member 35 and urged by a coil spring 36 towards its position as shown in FIG. 3A. The actuating member 34 has an operating portion 37, which can be displaced in a second direction. The operating portion 37 is urged downwardly by a leaf spring 38.

The body 31 acts as a cam, when the operating portion 37 is in the position as shown in FIG. 3A. This prevents operation of the actuating member 34 by accident. An operator has to move the operating portion 37 of the actuating member 34 upwardly in order to be able to press the actuating member inwardly and as a result to operate the safety member 33 (see FIGS. 3B and 3B). This embodiment has the advantage that the safety member 33 is not shifted within the tool body 31 and that operation of the actuating member does not depend on the position of the tool in the receiving structure.

Figure 4B:
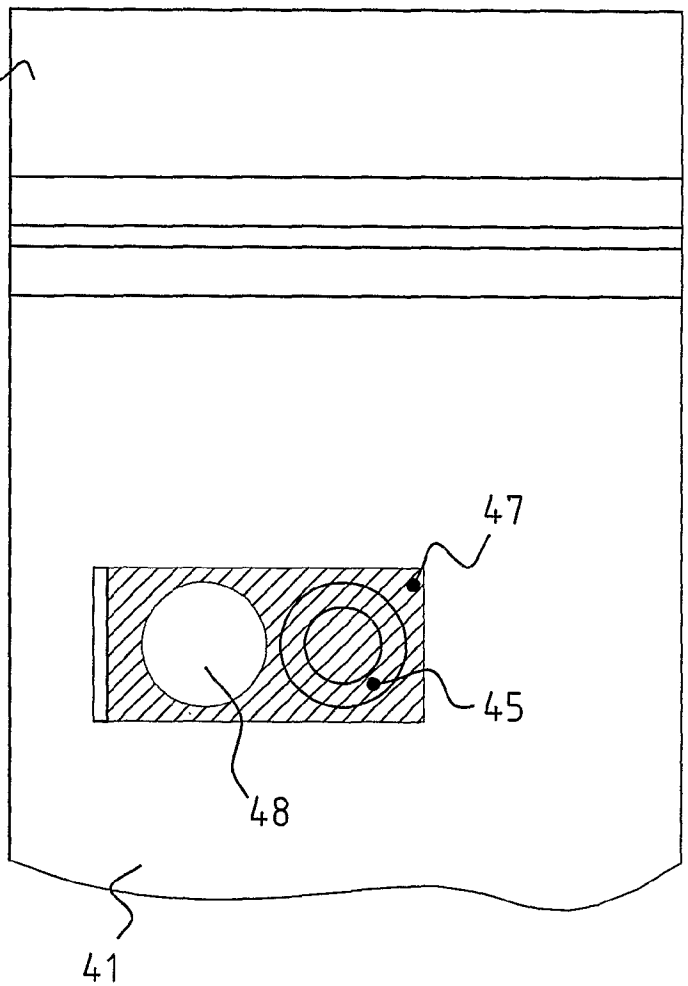
FIGS. 4A and 4B show a fourth embodiment of a press tool according to the invention.
Figure 4A:
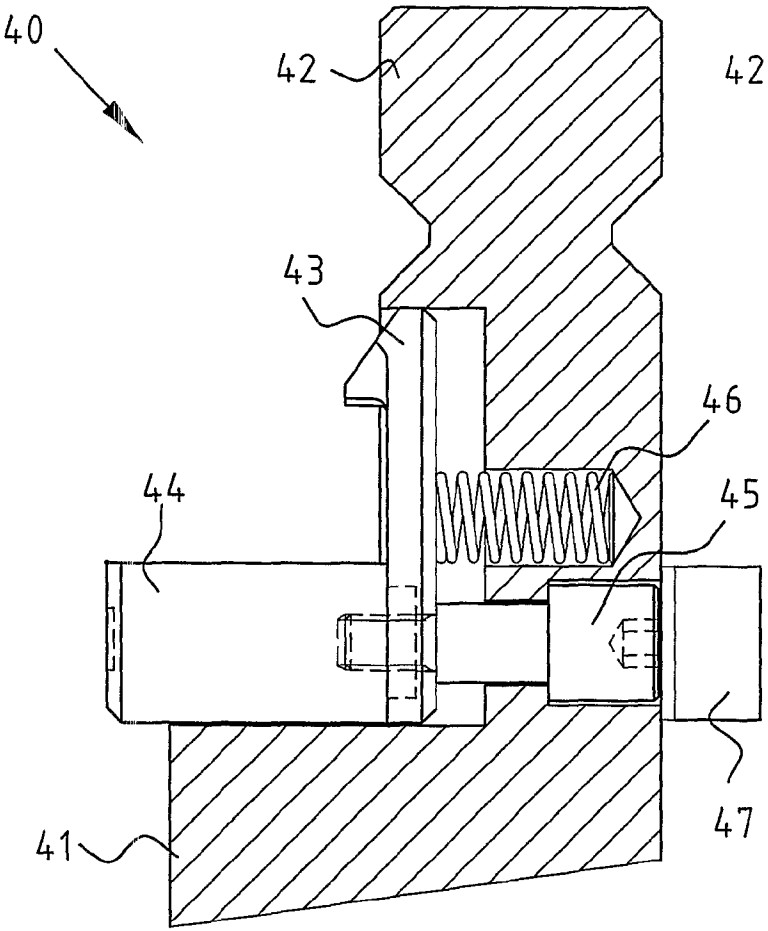

FIGS. 4A and 4B show a fourth embodiment 40 of the invention. The embodiment 40 has a tool body 41 and a receiving structure end 42. In the receiving structure end 42 a safety member 43 is arranged, which is operated by an actuating member 44. This actuating member 44 is guided by a guide member 45 and urged to the position as shown in FIG. 4A by spring 46. FIG. 4B shows a side view of the embodiment 40. A slide member 47 is arranged and has an opening 48. This slide member blocks in the shown position the guide member 45, such that the actuating member 44 cannot be operated. Only after sliding the slide member 47 the actuating member 44 can be operated and as a result the safety member 43 can be retracted into the receiving structure end 42.

Figure 5:
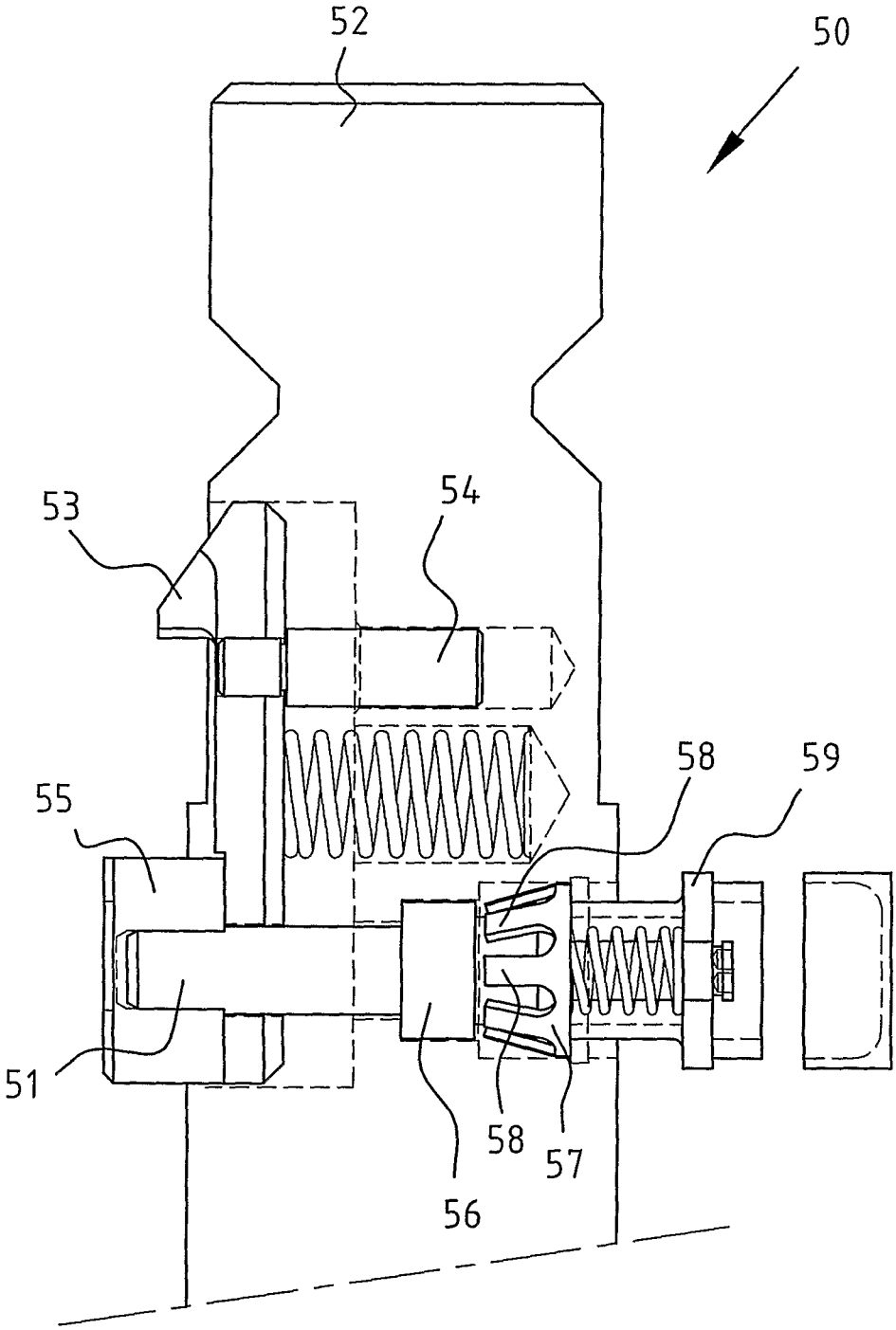
FIG. 5 shows a fifth embodiment according to the invention of a press tool in cross-sectional view.

FIG. 5 shows a fifth embodiment 50 according to the invention. The tool 50 has a body with a receiving structure end 52. This receiving structure end 52 has a safety member extending, which safety member is guided by a guide pin 54. The safety member 53 is actuated by an actuating member 55 which is in turn guided by a guide member 56. Behind the guide member 56 a spreading member 57 is present, which spreading member 57 has fingers 58. The fingers 58 are extending towards the axis 51 of the spreading member 57. A spreading actuating member 59 can be pressed into the spreading member 57 such that the fingers 58 are bent outwardly and provide a passage way for the guide member 56. Now the actuating member 55 can be pressed and the guide member 56 will slide through the spreading member 57.

Figure 6C:
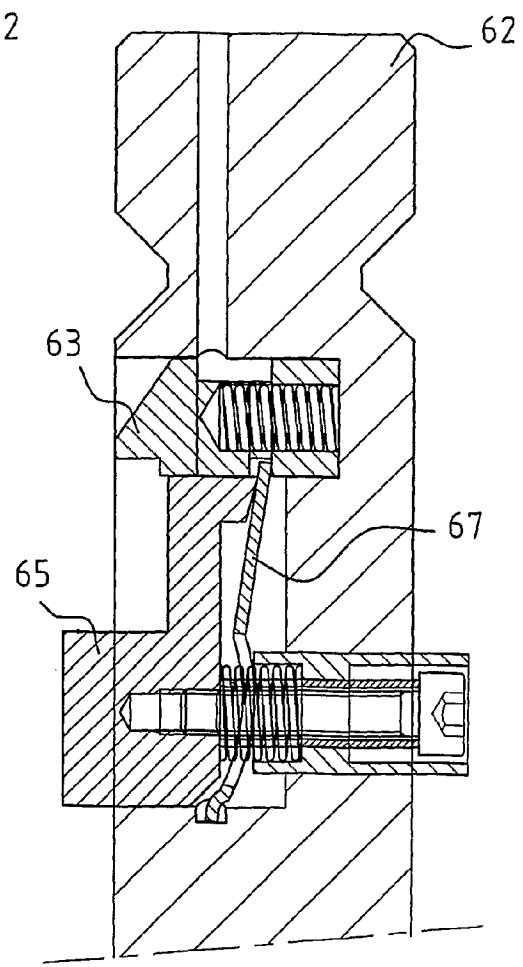
FIGS. 6A-6C show a sixth embodiment in cross-sectional view of the invention.
Figure 6B:
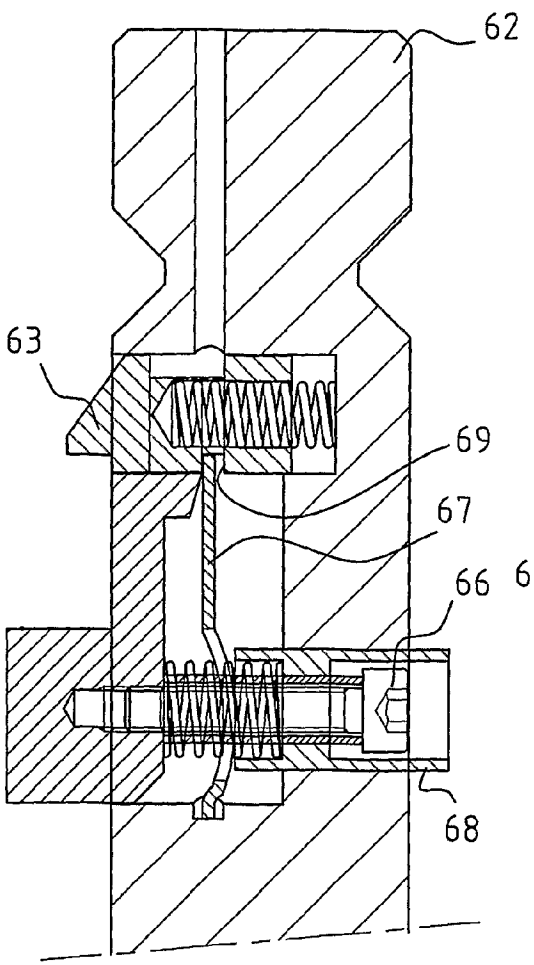
Figure 6A:
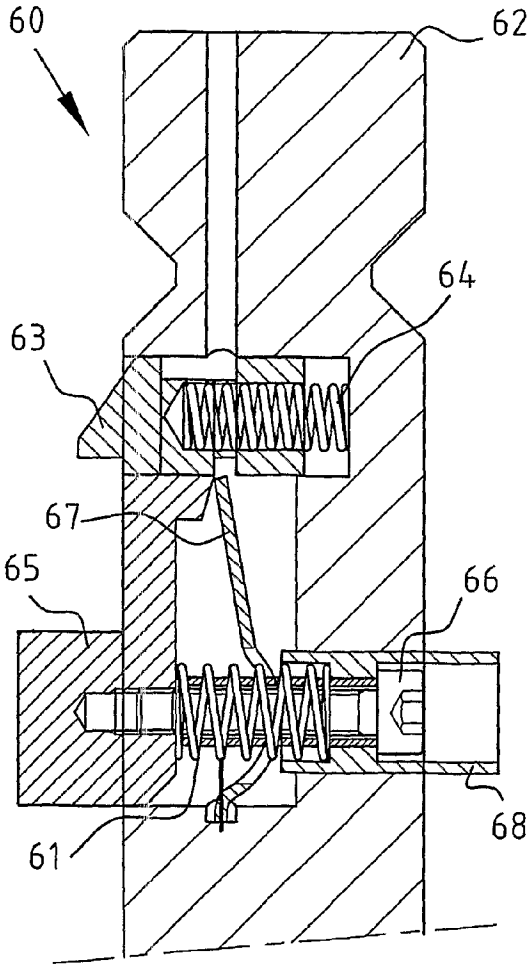

FIGS. 6A-6C show a sixth embodiment of a tool according to the invention. This embodiment 60 has a tool body and a receiving structure end 62. The receiving structure end 62 has a safety member 63 which can slide into the receiving structure end 62. The safety member 63 is urged by a coil spring 64.

The tool 60 has furthermore an actuating member 65, which can be slided into the tool body independent of the safety member 63. The actuating member 65 is guided by a guide member 66.

A leaf spring 67 is with one side arranged in the tool body 61. A lever actuating member 68 is coaxially arranged with the guide member 66 and urged by a spring 61.

In FIG. 6A the lever 67 is disengaged and when the actuating member 65 is operated the safety member 63 remains in its shown position.

In FIG. 6B the lever actuating member 68 is pressed such that the lever 67 deforms and engages into a cavity 69 of the safety member 63. When actuating member 65 is pressed (see FIG. 6C) it pushes against the lever 67 taking along the safety member 63.

Figure 7B:
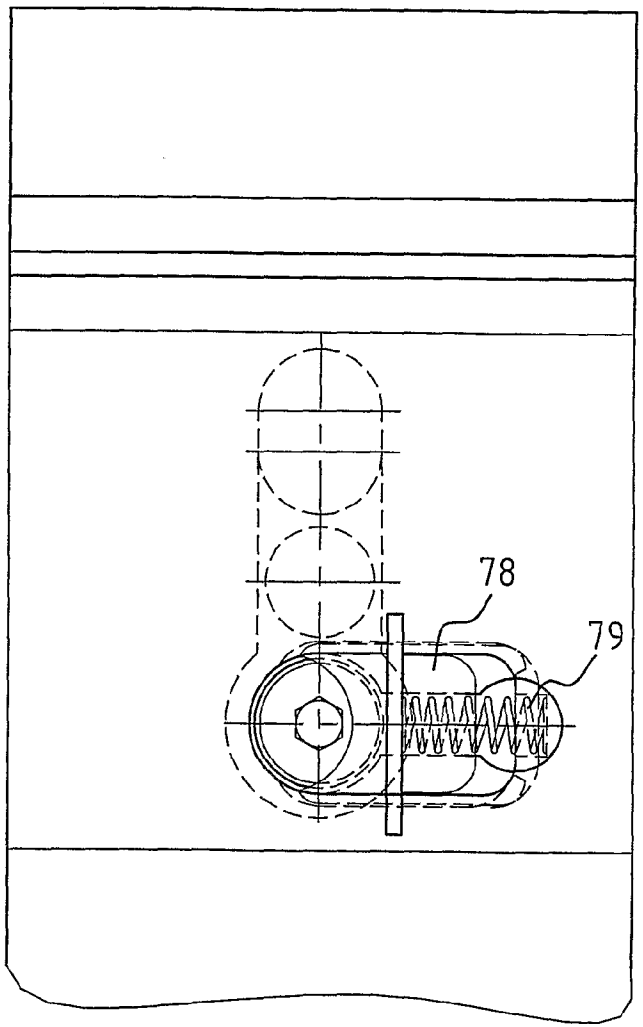
FIGS. 7A and 7B show a seventh embodiment of a press tool according to the invention.
Figure 7A:
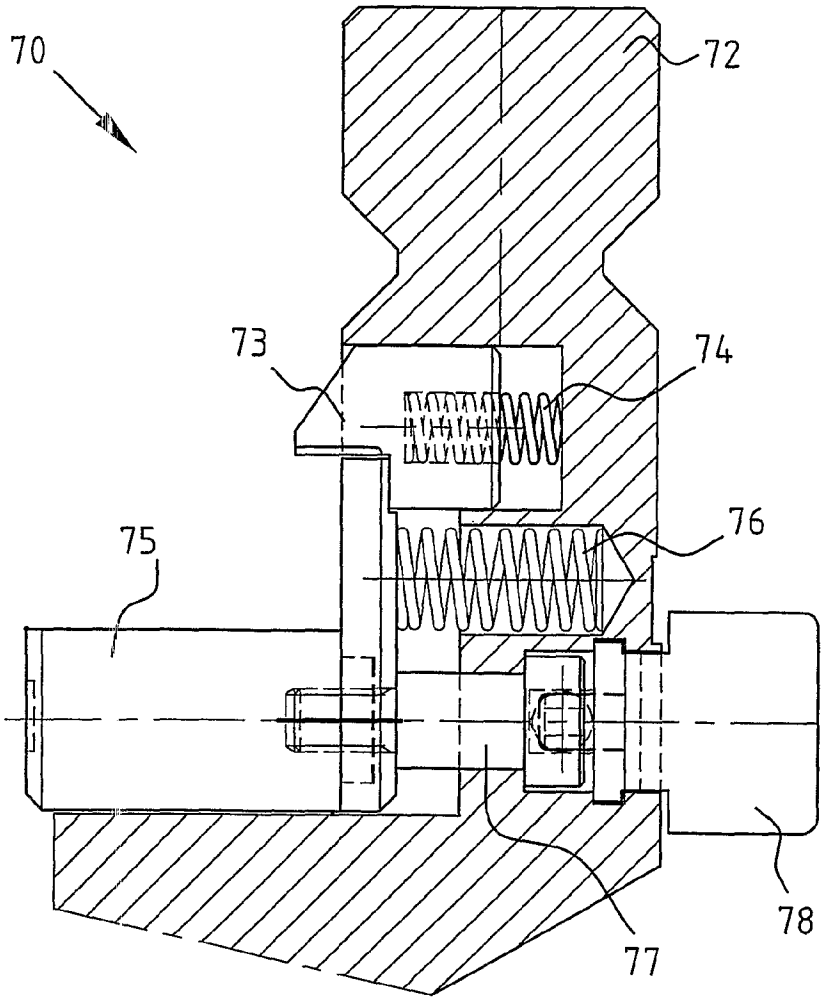

FIGS. 7A and 7B show a seventh embodiment of a press tool 70 according to the invention. This embodiment resembles the embodiment according to FIGS. 4A and 4B.

The tool 70 has a receiving end 72, in which a safety member 73 is arranged, which is urged by spring 74 towards its extended position.

An actuating member 75 is urged by a spring 76 into the position shown in FIG. 7A. The actuating member 75 can push the safety member 73 into a retracted position.

The safety member 73 is however freely movable, such that the tool 70 can be inserted into a receiving structure independent of the state of the actuating member 75.

The actuating member 75 is guided by a guide pin 77, which can be blocked by slide member 78. As shown in figure 7B the slide member 78 is also spring loaded by spring 79, such that the slide member 78 is always urged towards the blocking position. So the actuating member 75 is always immobilized, unless the slide member is expressly moved towards the unblocking position enabling the actuating member 75 to be pressed inward and operating the safety member 73.

The freely movable safety member configuration as shown in FIGS. 7A and 7B can likewise be incorporated in the embodiments shown in FIGS. 3, 4 and 5.

The invention claimed is:

1. A device for forming, comprising:

a body having a receiving structure end for receiving into a receiving structure of a folding press, which end is connected via a central portion to a tool end, at least one safety member configured to protrude beyond a surface plane of the receiving structure end, an actuating member which is movable in a first direction and which is coupled to the safety member, and immobilizing means for making the actuating member inoperative, wherein the immobilizing means blocks the actuating member, such that operation of the actuating member is only enabled after unblocking the immobilizing means, and wherein the actuating member is configured to be user actuated by pressing on it.

2. The device according to claim 1, wherein the immobilizing means comprise at least one cam for blocking movement of the actuating member in a first direction, and wherein at least a part of the actuating member is movable in a second direction different from the first direction, such that the actuating member can be moved beyond the blocking cam.

3. The device according to claim 2, wherein the second direction is substantially perpendicular to the first direction.

4. The device according to claim 2, comprising spring means, such as a leaf spring or coil spring, for urging the actuating member in the second direction towards the blocking position.

5. The device according to claim 2, wherein the at least one cam is arranged at the body.

6. The device according to claim 2, wherein the actuating member has an operating portion which is movable in the second direction.

7. The device according to claim 2, wherein the actuating member is rigidly connected to the safety member.

8. The device according to claim 1, wherein the actuating member comprises a guide member extending in the actuating direction and wherein the immobilizing means comprise blocking means for blocking the movement of the guide member.

9. The device according to claim 8, wherein the blocking means comprise a slide member arranged at the body, which slide member is slidable to a position blocking the movement of the guide member.

10. The device according to claim 8, wherein the blocking means comprise a spreading member arranged relative to the guide member such that the spreading member is blocking (or deblocking) the movement of the guide member in non-spreaded state, and relative to a spread actuating member for bringing the spreading member in a spreaded state unblocking (or blocking) the guide member.

11. The device according to claim 10, wherein the spreading member comprises a ring and fingers arranged to the ring extending towards the axis of the ring, and wherein the spread actuating member is a pin having a diameter smaller than the inner diameter of the ring.

12. The device according to claim 1, wherein the safety member is slidably arranged in the body, wherein the actuating member is slidably arranged in the body and further comprising a lever coupled between the actuating member and the safety member and wherein the immobilizing means comprise a lever actuating member for moving the lever from a disengaged position to an engaged position.

13. The device according to claim 12, wherein the lever actuating member is substantially coaxially arranged to the actuating member.

14. The device according to claim 13, wherein the actuating member comprises a guide member extending in the actuating direction and the lever actuating member is slidably guided by the guide member.

15. The device according to claim 11, wherein the lever is a leaf spring.

16. The device according to claim 1, wherein the safety member is slidably arranged in the body and the safety member is movable between an extended and a retracted position, independent of actuation of the actuating member.

* * * * *